US008132669B1

(12) United States Patent
Stubel

(10) Patent No.: US 8,132,669 B1
(45) Date of Patent: Mar. 13, 2012

(54) BINOCULAR CASE

(75) Inventor: Marc A Stubel, Dix Hills, NY (US)

(73) Assignee: Carson Optical, Inc., Hauppauge, NY (US)

( * ) Notice: Subject to any disclaimer, the term of this patent is extended or adjusted under 35 U.S.C. 154(b) by 0 days.

(21) Appl. No.: 12/878,092

(22) Filed: Sep. 9, 2010

(51) Int. Cl.
*B65D 85/38* (2006.01)

(52) U.S. Cl. ..... 206/316.3

(58) Field of Classification Search ..... 206/316.1, 206/316.2, 316.3, 576, 472; 150/154
See application file for complete search history.

(56) References Cited

U.S. PATENT DOCUMENTS

| | | | | |
|---|---|---|---|---|
| 2,858,415 | A * | 10/1958 | Alfors et al. | 362/8 |
| 3,299,931 | A * | 1/1967 | Kritzler | 206/316.2 |
| 3,977,013 | A * | 8/1976 | Svatek | 396/423 |
| 4,138,045 | A * | 2/1979 | Baker | 224/236 |
| 4,142,566 | A * | 3/1979 | Stolp | 206/316.3 |
| 4,649,973 | A | 3/1987 | Uchin | |
| 4,865,191 | A | 9/1989 | Easter | |
| 5,639,004 | A * | 6/1997 | Carlton et al. | 224/579 |
| 5,695,067 | A * | 12/1997 | Harvey | 206/579 |
| 5,816,464 | A | 10/1998 | Seiler | |
| 5,996,790 | A * | 12/1999 | Yamada et al. | 206/316.1 |
| 6,095,328 | A * | 8/2000 | Smithbaker et al. | 206/316.3 |
| 6,264,029 | B1 * | 7/2001 | Motson | 206/320 |
| 6,672,452 | B1 * | 1/2004 | Alves et al. | 206/232 |
| 6,926,184 | B2 | 8/2005 | Hancock et al. | |
| 6,929,125 | B1 * | 8/2005 | Seamans | 206/316.1 |
| 7,036,943 | B1 | 5/2006 | Brewer | |
| 7,104,398 | B1 * | 9/2006 | Wisecarver | 206/316.3 |
| D601,341 | S | 10/2009 | Arman | |
| 2003/0029895 | A1 | 2/2003 | Andersen | |
| 2007/0051645 | A1 * | 3/2007 | Hassett | 206/316.2 |
| 2008/0116697 | A1 | 5/2008 | D'Ambrosio | |

OTHER PUBLICATIONS

User Manual, BA-03 BinoArmor, Carson Optical Inc., www.carsonoptical.com.

* cited by examiner

*Primary Examiner* — Jacob K Ackun
(74) *Attorney, Agent, or Firm* — Carmody & Torrance LLP

(57) ABSTRACT

A carrying case for a device having a "look into" end and a "see out of" end, wherein the carrying case comprises a main panel having an inner side surface to which a device is coupleable and also having at least a first edge; a back panel, having at least a first edge, and coupled to the main panel, such that the back panel is rotatable (i) away from the main panel to an open position and (ii) towards the main panel to a closed position; at least one side panel having at least a first edge alignable with the at least first edge of the main panel, and at least a second edge alignable with the at least first edge of the back panel, wherein at least one pair of alignable edges are releasably secured such that the edges are connected in the closed position and disconnected in the open position, and wherein in the open position a line of sight is created between an object, the "see out of" end of the device and the "look into" end of the device.

16 Claims, 5 Drawing Sheets

BINOCULAR CASE

BACKGROUND OF THE INVENTION

The present invention relates generally to protective carrying cases thr devices with a "look into" end and a "see out of" end and more particularly relates to a novel and improved protective carrying case for optical instruments, more specifically binoculars, which protects the instrument while it is in storage and provides quick, quiet and easy access for the instrument to be used. Also provided herein are methods of using the cover of the present invention.

Binoculars and other optical instruments are often used by hunters, bird watchers, and other sportsmen to view wildlife. To protect binoculars from damage sportsmen will often store the binoculars in a knapsack or other storage medium. If game or wildlife is sighted or if a need otherwise arises to have immediate access to the binoculars, however, such storage does not permit ready access. For example, once game is sighted the sportsman would wish to confirm the identification of game through the use of binoculars.

The prior art recognizes the desire of providing protective binocular carrying cases. However, these storage devices often either lack sufficient protection or hinder the accessibility of the instrument. Prior art recognizes these two needs, but improvement in the meeting of both of these needs in a single storage medium is desirable.

Thus a storage medium that provides both easy access and more complete protection while avoiding mechanical complication would provide distinct and desirable advantages over the prior art. It is thus believed that the present invention overcomes the aforementioned deficiencies and achieves the aforementioned and below mentioned objectives.

SUMMARY AND OBJECTIVES OF THE PRESENT INVENTION

It has long been felt that protection is needed for optical instruments while being used in the field as is evidenced by the array of lens caps both attachable and not, and various covering devices to protect the instruments. Heretofore a full protective carrying case designed for quick, quiet and easy use in the field, while remaining conveniently attached to the instrument has not been available.

To overcome the perceived deficiencies in the prior art and to achieve the objects and advantages set forth above and below, the present invention is, generally speaking, directed to a protective carrying case for optical instruments, more specifically binoculars.

For example, it is objectives of the present invention to provide an improved protective carrying case for optical instruments, more specifically binoculars, that adequately protects the instrument and does not hinder the accessibility of the instrument. Said protective carrying case is less complicated, easier to use, quiet, and generally more desirable and versatile than prior art constructions.

Another object of the present invention is the additional features of easy attachment and detachment to and from the optical instrument.

Yet another object of the invention would be to provide a case that is lightweight, durable, inexpensive and attractive.

A still further object of the invention is that the case be quiet to open and close, a necessity when observing birds or other wildlife.

Further objectives and advantages of this invention will become more apparent from a consideration of the drawings and ensuing description.

The invention accordingly comprises the features of construction, combination of elements, arrangement of parts and sequence of steps which will be exemplified in the construction, illustration and description hereinafter set forth, and the scope of the invention will be indicated in the claims.

The protective carrying case should protect the lenses, body, tube, adjustment knobs and attachments of the instrument. Such a case should provide protection against rain, snow, dust, twigs and the like. The case should also prevent damage if the instrument is hit against a foreign object. Moreover, the case should be quick and easy to open allowing use of the instrument while remaining attached to the case, thereby preventing loss or droppage of the case.

In one preferred embodiment, the protective carrying case comprises a main panel to which the instrument is coupleable; a back panel, connected either directly or indirectly to the main panel at one end such that it is possible to rotate the back panel (i) away from the main panel to an open position and (ii) towards the main panel to a closed position; at least one side panel, aligned such that it has corresponding edges with the main panel and back panel, wherein at least one pair of corresponding edges are directly connected, and at least one other pair of corresponding edges are releasably connected such that the connection is secured in the closed position and released in the open position, and wherein the open position is characterized by a line of sight created between an object, the instrument and the user.

In another preferred embodiment, the protective carrying case comprises a shaped bottom to which the device is coupleable; a shaped covering, connected either directly or indirectly to the shaped bottom at one end such that it is possible to rotate the shaped covering (i) away from the shaped bottom to an open position and (ii) towards the shaped bottom to a closed position, aligned such that it has corresponding edges with the shaped bottom, wherein at least one other pair of corresponding edges are releasably connected such that the connection is secured in the closed position and released in the open position and wherein the open position is characterized by a line of sight created between an object, the instrument and the user.

In yet another preferred embodiment, a method of moving the case between an open position and a closed position is provided. The method comprises the steps of releasing the releasable connection(s) of the at least one side panel, and rotating the back panel away from the main panel, whereby a line of sight is created between the object to be viewed, the "see out of" end, and the "look into" end of the device.

In accordance to the present invention, the instrument is connected to the opposite ends of a looped carrying strap or shoulder harness. The end portions of the strap or shoulder harness are attached to the binoculars through apertures in the cover.

The novel and improved protective carrying case for devices with a "look into" end and a "see out of" end is not limited to use with binoculars, but may be modified for use with other types of instruments and especially optical instruments adapted for use in the field, including, but not limited to, telescopes, cameras, spotting scopes, rangefinders, and monoculars.

BRIEF DESCRIPTION OF THE DRAWINGS

The above set forth and other features of the invention are made more apparent in the ensuing Description of the Preferred Embodiments when read in conjunction with the attached drawings, wherein.

Identical reference numerals in the figures are intended to indicate like parts, although not every feature in every figure may be called out with a reference numeral.

DETAILED DESCRIPTION OF THE PREFERRED EMBODIMENTS

Figure 1:
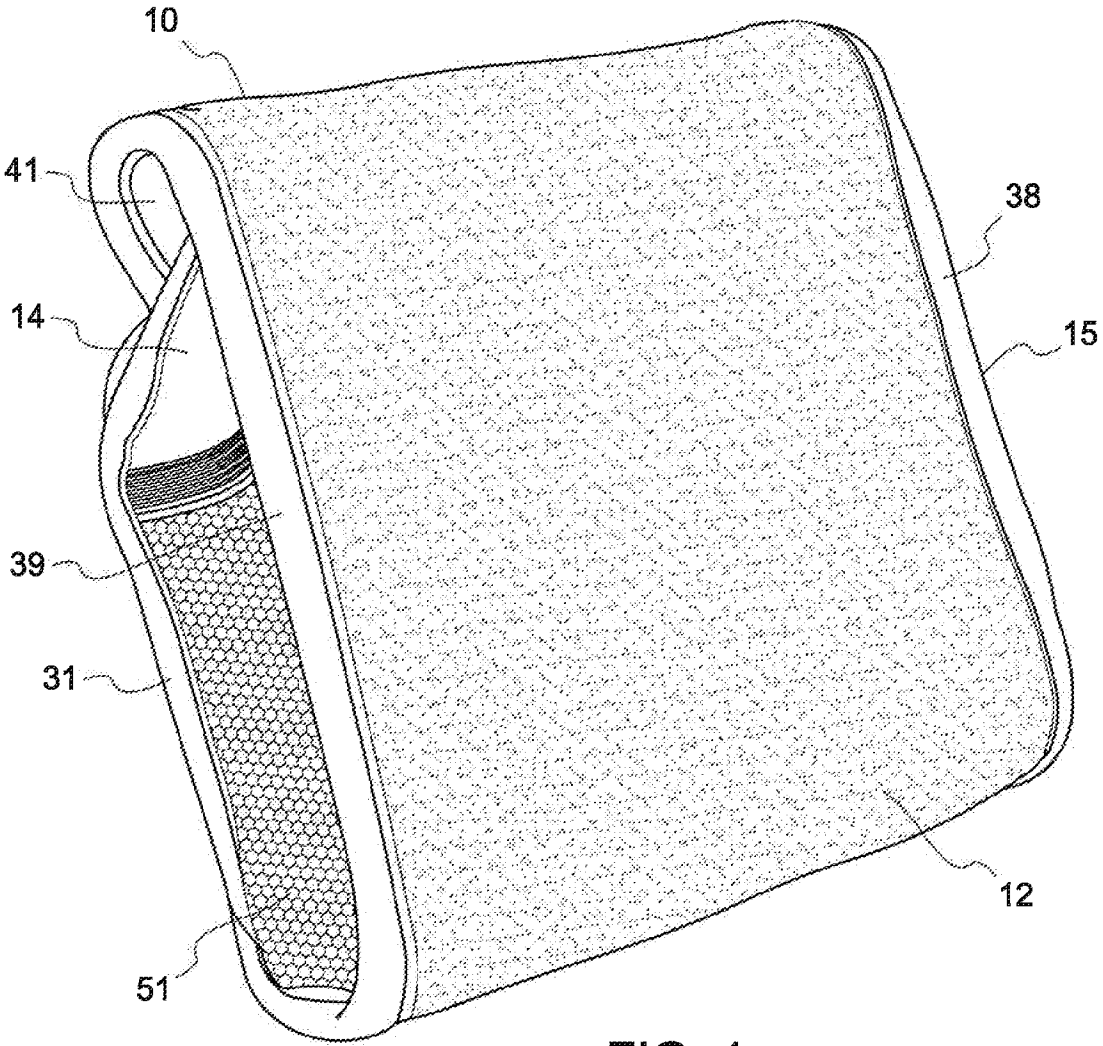
FIG. 1 is a perspective view of the preferred embodiment of the protective carrying case in the closed position being used in conjunction with the operation of a conventional set of binoculars.

Reference is now made to the Figures, which illustrate a protective carrying case, generally indicated at 10, constructed in accordance with preferred embodiments of the present invention. Prior to discussing the specifics, however, general overviews, features and advantages thereof shall be discussed.

For example, in accordance with a first embodiment of the present invention, the protective carrying case 10 is designed for an optical instrument B and preferably a binocular having a "look into" end 22 and a "see out of" end 21. In this preferred embodiment, protective carrying case 10 composes a main panel 11, to which the optical instrument B is coupleable, a back panel 12 connected to the main panel 11 at one end 37, side panels 14, 15 are directly connected at corresponding edges 35, 36, 38, 39 to the back panel 12 and have edges 31, 32 which are releasably connected to corresponding edges 33, 34 of main panel 11. The back panel 12 is extended by a flap 41 which is releasably secured to main panel 11.

In a specific embodiment, the main panel, back panel, and side panels are of a unitary piece of material (i.e. comprise a single unit) and thus would be of the same material, and may be a flexible cloth fabric and/or an elastic material such as neoprene, nylon or soft polymeric material by way of example and not limitation.

Alternatively, the various panels may be of the same material, but may be cut into separate pieces that are directly attached (e.g. sewn or glued) and/or indirectly attached by for example and not limitation, rigid material such as hard plastic or acrylic or flexible material such as elastic strap(s), rubber and/or stretchy fabric, all of the foregoing being by way of example with other materials still being possible by those skilled in the art and in keeping with the objectives of the present invention.

In further alternatives, the various panels may be of multiple differing materials and coupled and/or joined either by direct attachment such as sewing or gluing or indirect attachment such as by rigid material again such as hard plastic or acrylic or by flexible material again such as elastic strap(s), rubber and/or stretchy fabric. Again all of the foregoing being by way of example with other materials still being possible by those skilled in the art and in keeping with the objectives of the present invention.

As alluded to above, the various panels may themselves be comprised of differing material, for example, for the purposes of different flexibilities, intending that a more flexible material cover a larger section of the instrument vis a vis a smaller section of the instrument. However, if the panels are of the same material, preferable materials may be those that are soft and flexible, such as neoprene, nylon, leather or soft polymeric substitute or hard and rigid materials such as plastic, metal, acrylic, ceramic or polymeric substitute, again all the foregoing being by way of example with other materials still being possible by those skilled in the art and in keeping with the objectives of the present invention. Here again, and generally speaking with respect to all the embodiments, the panels may be of different shapes and/or sizes, such that one panel is larger in relation to another, to better fit differing size instruments.

In another feature, the instrument can be coupled to the main panel of the case by means of elastic strap(s), magnets, screw(s), Velcro (i.e. hook and pile) or laces, although here again all of the foregoing being by way of example and not limitation as should be understood by those skilled in the art and in keeping with the objectives of the present invention.

Furthermore, and as also contemplated, when in the closed position, the case may completely cover the instrument, may significantly cover the instrument, or not significantly cover the instrument, such that the sides and the "look into" and "see out of" ends of the device are the only sections that are significantly covered and/or is comprised of multiple elements to increase coverage of the instrument.

Figure 2:
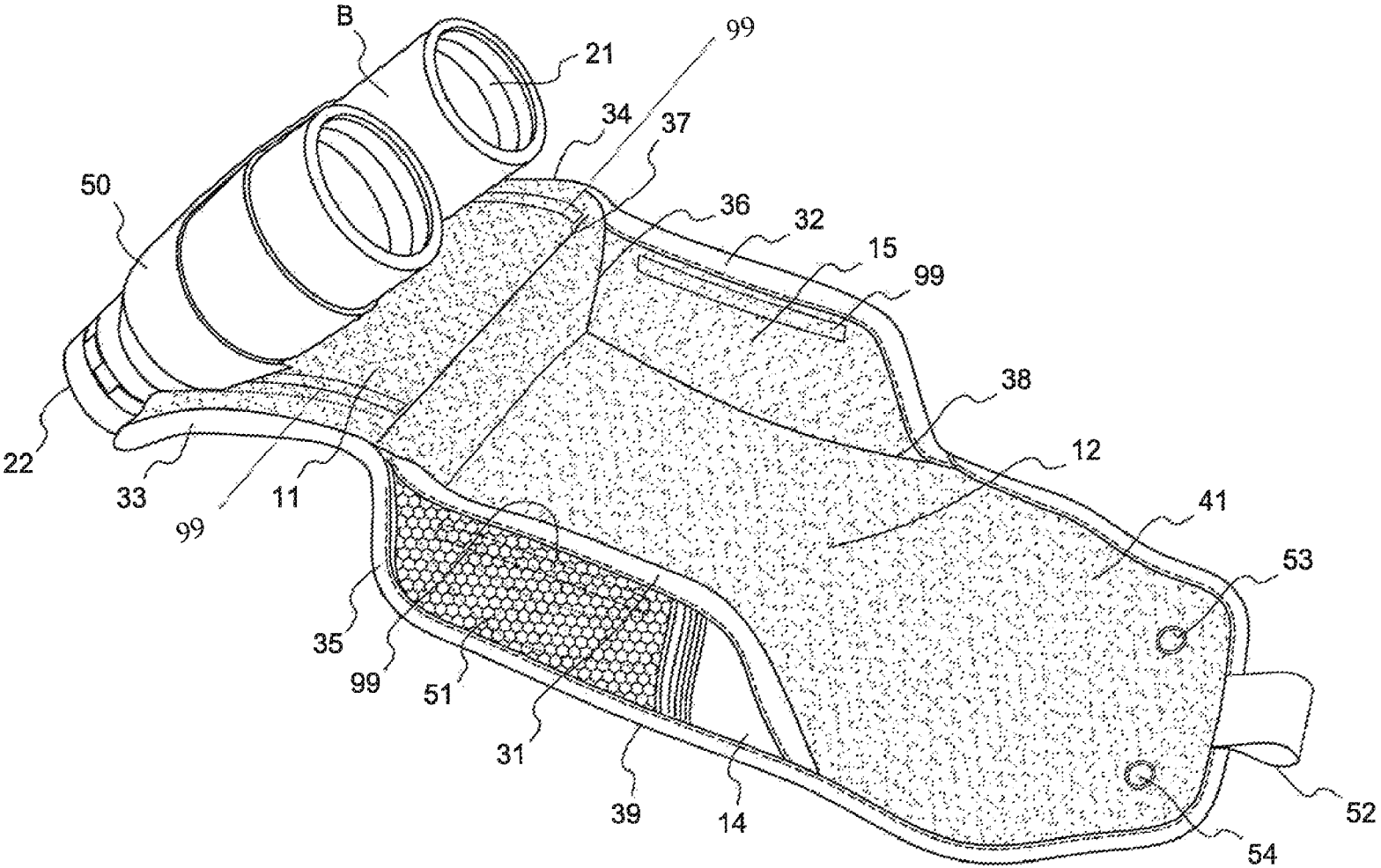
FIG. 2 is a perspective view of the preferred embodiment of the protective carrying case in the open position being used in conjunction with the operation of a conventional set of binoculars.
Figure 3:
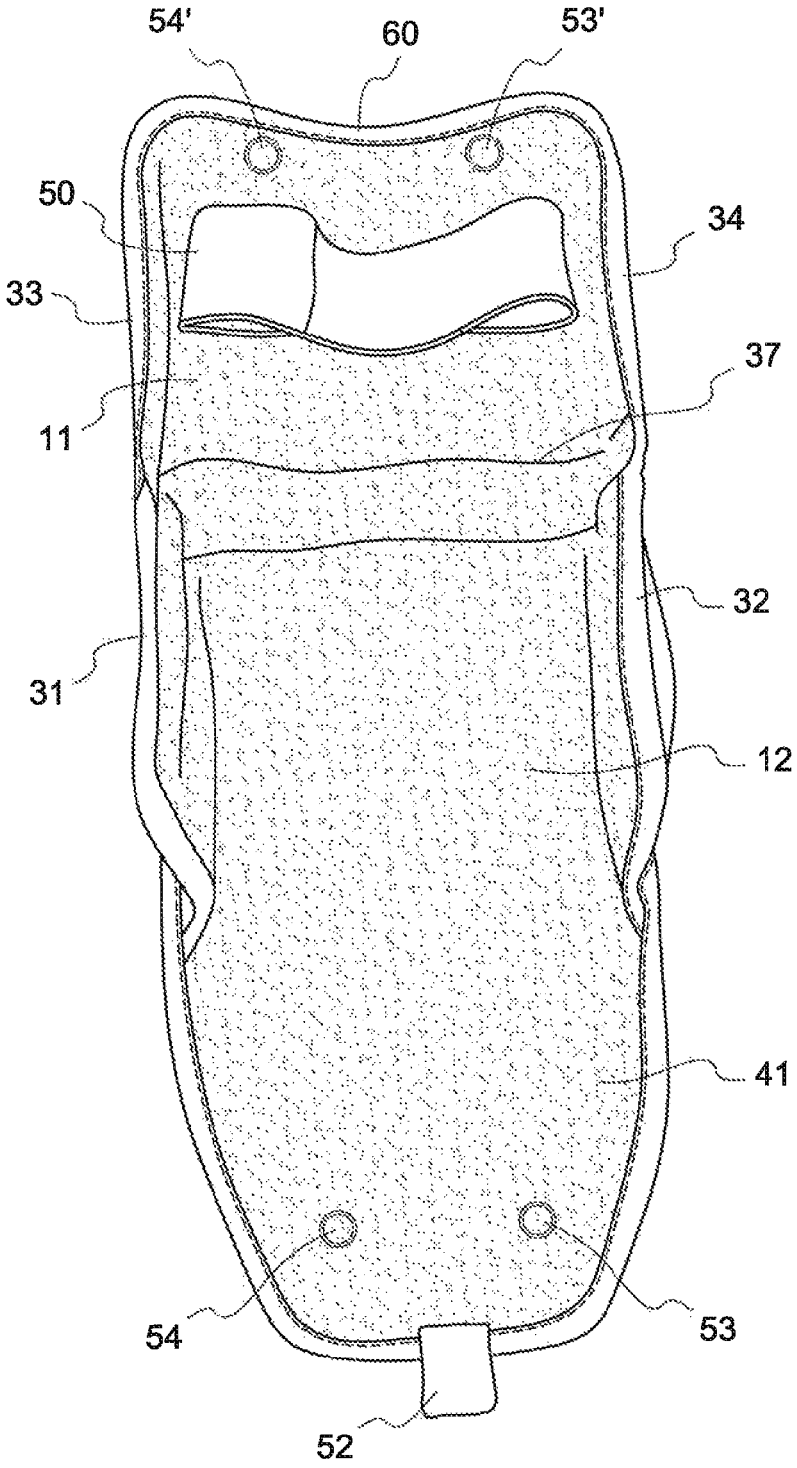
FIG. 3 is a top plan view of the preferred embodiment of the protective carrying case in the open position.

As but another feature, the releasable means of attachment formed between corresponding edges of each panel, configured to secure the case in a closed position may be provided in the form of one or more magnets, snaps, buttons, clasps, buckles, hook and receptacle or of Velcro (i.e. hook and pile), generally and generically indicated at 99 in FIG. 2 for illustrative purposes although here again all of the foregoing being by way of example and not limitation as should be understood by those skilled in the art and in keeping with the objectives of the present invention.

In another advantageous feature, one or multiple graspable tabs may be provided to facilitate the gripping and opening and closing of the cover around the instrument.

In an additional advantageous feature, when in the closed position, a single or multiple apertures may be formed due to one or more of the edges of the at least one side panel being shorter than its corresponding edge on the main panel, back panel, or intermediate panel, wherein a neck cord, shoulder harness, belt clip, or other carrying means may be connected directly to the device, through the at least one aperture.

In another feature, the back panel may be extended by a flap that can wrap around the "look into" end of the instrument and around the outside of the main panel and releasably connect to the outside face of the main panel. The releasable means of attachment formed between the flap and main panel, configured to secure the case in a closed position may be provided, in the form of one or more magnets, snaps, buttons, clasps, buckles, hook and receptacle or of Velcro (i.e. hook and pile), although here again all of the foregoing being by way of example and not limitation as should be understood by those skilled in the art and in keeping with the objectives of the present invention.

In addition, one or more graspable tabs may be located on the flap to facilitate gripping, releasing the connections, and moving the back panel to the closed or open position.

In yet another feature, pockets, pouches, or some other storage member of similar construction may be provided on one or multiple panels. As but one advantage provided thereby, the present invention could be used to store additional equipment, instrument accessories, attachments, cleaning devices, lenses, lens covers, lens clothes, identification cards, or other personal articles as contemplated herein as the pockets, pouches, etc. could be used to permit the storage of one or multiple items.

With the above in mind, reference is now made specifically to the figures in connection with the following disclosure.

Referring in more detail to the drawings, as shown in FIGS. 1-5, a preferred embodiment of the present invention is described. In this particular preferred embodiment a novel and improved protective carrying case for instruments with a "look into" end and a "see out of" end is illustrated. It is to be clearly understood that this preferred embodiment is provided for descriptive purposes only and is not meant to unduly limit the scope of the inventive concept. Other embodiments and applications are included within the inventive concept as set forth.

For example, in accordance with the preferred embodiment of the present invention, the protective carrying case 10 is designed for an optical instrument B and preferably a binocular having a "look into" end 22 and a "see out of" end 21. In this preferred embodiment, protective carrying case 10 comprises a main panel 11, to which the optical instrument B is coupleable by means of elastic band 50, a back panel 12 connected to the main panel 11 at one end 37, side panels 14, 15 are directly connected at corresponding edges 35, 36, 38, 39 to the back panel 12 and have edges 31, 32 which are releasably connected to corresponding edges 33, 34 of main panel 11. The back panel 12 is extended by a flap 41 which is releasably secured to main panel 11. The flap 41 contains magnets 53, 54 which can line up and be secured to magnets 53', 54' in the main panel 11. A graspable tab 52 is located on the end of flap 41 to facilitate gripping.

As shown in FIG. 1, when in the closed, position edges 31, 32 of the side panels 14, 15 line up and releasably secure to corresponding edges 33, 34 of the main panel 11. Back panel 12 is wrapped around the instrument protecting the "see out of" end 21 and the top of the instrument. The side panels 14, 15 protect the sides of the instrument. The flap 41 extending from back panel 12 is wrapped around and over the "look into" end 22 of the instrument, providing protection, and secures to the main panel 11 by corresponding magnets 53, 53', 54, 54'.

Figure 5:
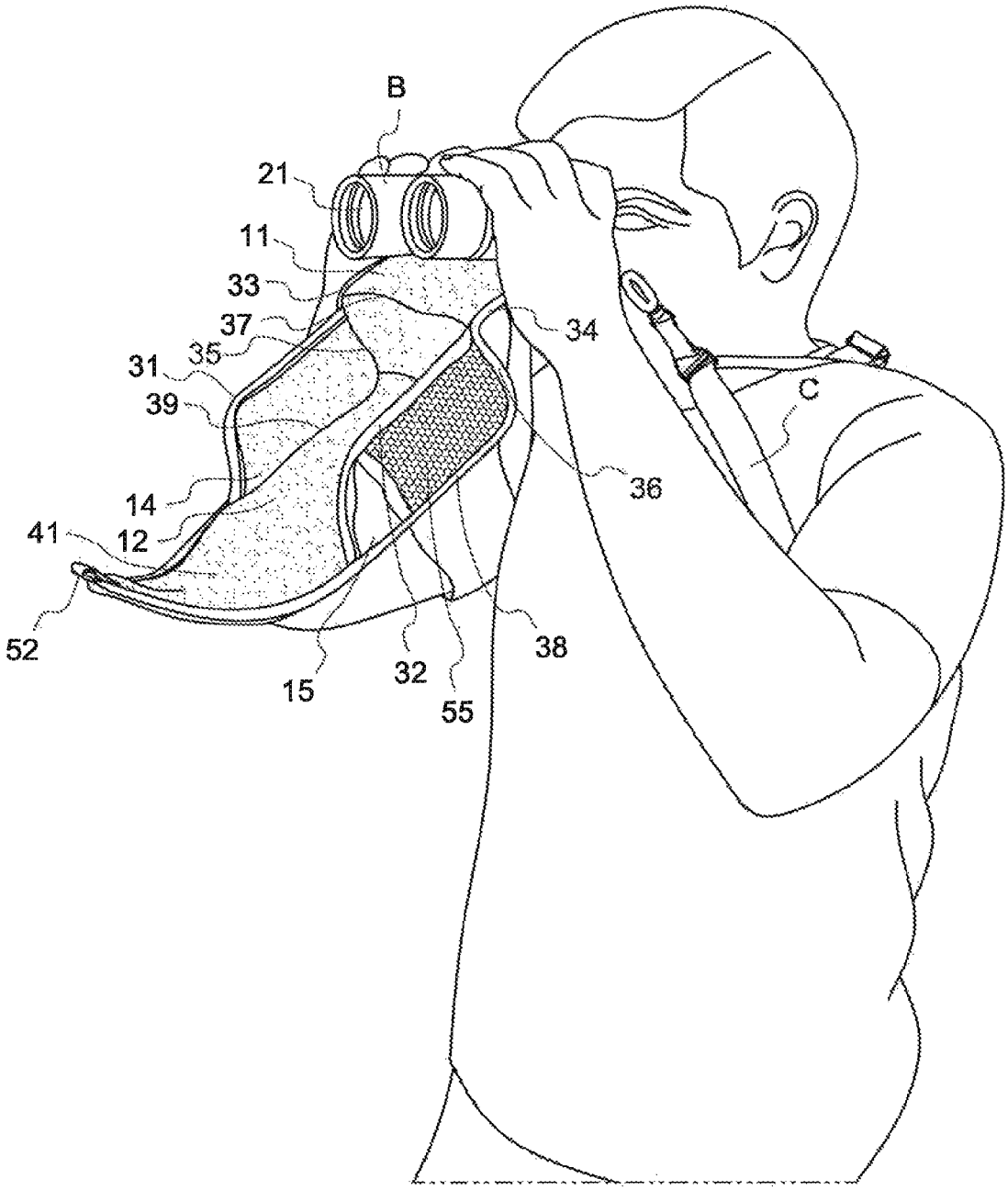
FIG. 5 is a perspective view of the preferred embodiment of the protective carrying case in the open position being used in conjunction with the operation of a conventional set of binoculars.

To move the case from the closed position as shown in FIG. 1 to the open position as shown in FIG. 2, the user can grip the graspable tab 52 or the flap 41 and pull it away from the main panel 11. This will release the magnets 53, 54, 53', 54' so that the flap 41 is no longer connected to the main panel 11. The flap 41 can then be rotated away from the main panel 11 which in turn releases the releasable connection between the corresponding edges 31, 32 of the side panels 14, 15 and the corresponding edges 33, 34 of the main panel 11 allowing the back panel 12 to rotate around edge 37. The flap 41, back panel 12, side panels 14, 15 can then be allowed to hang below the main panel 11 completely disposing the optical instrument, binoculars B in the preferred embodiment, creating a line of sight between a distant object, the "see out of" end 21 of the instrument, the "look into" end 22 of the instrument, and the user as shown in FIG. 5. The main panel 11 contains a cut out 60 that prevents the user's nose or other part of the face from rubbing against the main panel 11 and causing discomfort to the user. The main panel 11 is made from a flexible material, such as neoprene, so that the binoculars B can be adjusted while still coupled to the main panel 11. While the instrument B is disposed when the carrying case 10 is in the open position, access is available to remove lens caps or coverings, focus adjustments or knobs, lens adjustments, eyecups, or any other adjustments.

Figure 4:
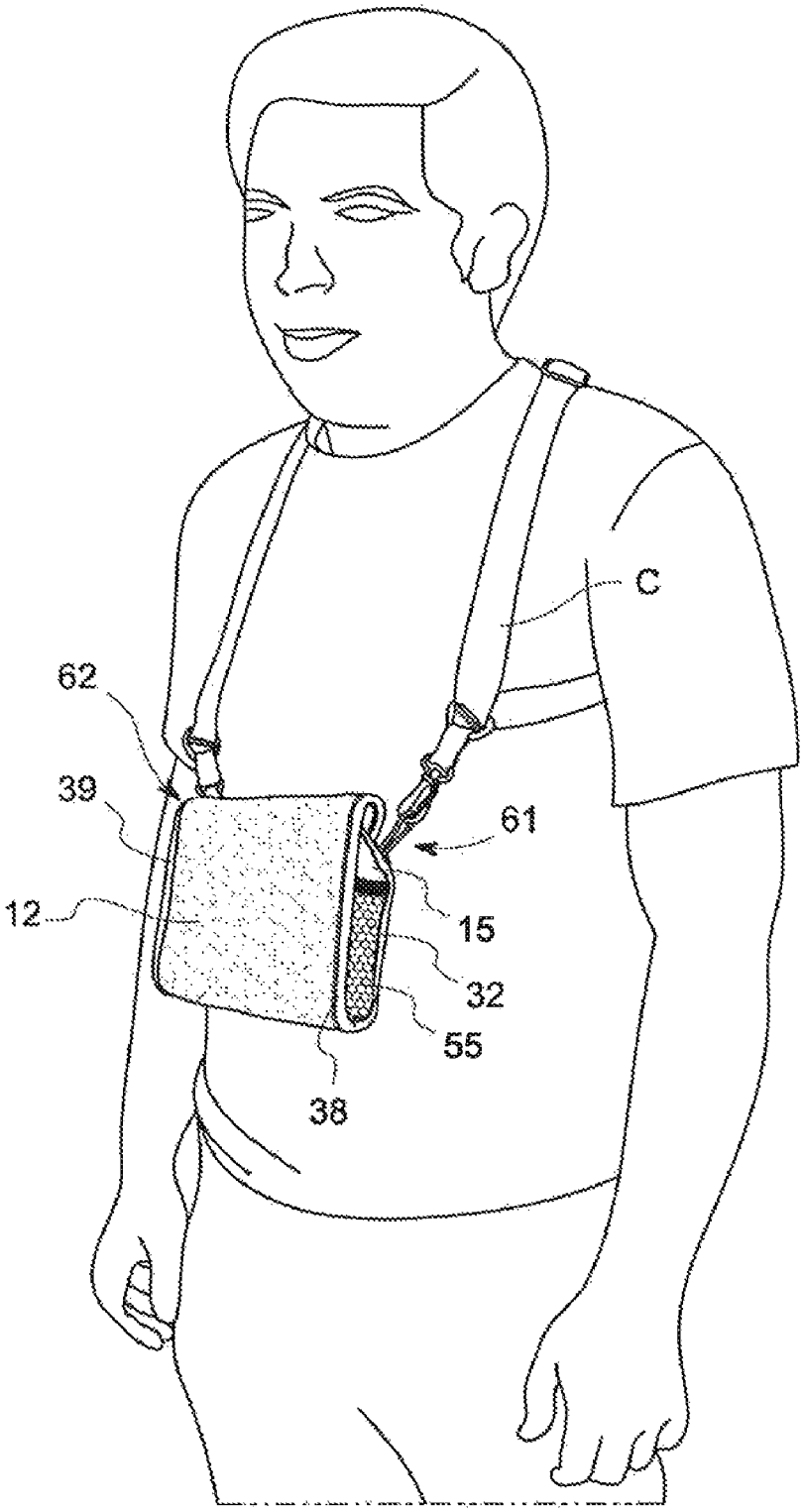
FIG. 4 is a perspective view of the preferred embodiment of the protective carrying case in the closed position being used in conjunction with the operation of a conventional set of binoculars.

FIG. 4 shows the protective carrying case 10 in the closed position being used in conjunction with a conventional pair of binoculars B attached to a shoulder harness C. When in the closed position the back panel 12, flap 41, side panels 14, 15, and main panel 11 form apertures 61, 62. Apertures 61, 62 create an opening in which the shoulder harness C can be directly connected to the binoculars B while coupled to case 10. Shoulder harness C can remain attached to binoculars B even when case 10 is in the open position as shown in FIG. 5.

To move the case from the open position as shown in FIG. 2 to the closed position as shown in FIG. 1 the user can grip the graspable tab 52 or the flap 41 and pull it towards the main panel 11. Once edges 31, 32 line up with corresponding edges 33, 34 on the releasable attachments will secure the side panels 14, 15 to the main panel 11. The flap 41 can then be wrapped over and around the "look into" end 22 of the binoculars B and over the main panel 11. Magnets 53, 54 in the flap 41 line up and secure to magnets 53', 54' in the main panel.

Mesh pockets 51, 55 are located on the side panels 14, 15 for storage of additional equipment, instrument accessories, attachments, cleaning devices, lenses, lens covers, lens clothes, identification cards, licenses, or other personal articles as contemplated herein as the pockets could be used to permit the storage of one or multiple items.

Importantly, it should be understood that the fact that the reference numerals used herein may capture or otherwise point to various and/or more than one element in the figures should not be interpreted in a limiting sense. That is, it is intended that the claims cover the inventive aspects and features of the present invention, but with recognition that particular feature or element although otherwise disclosed or indicated by reference numeral in the figures, need not be read into the claims.

It can thus be seen that the present invention is advantageous and overcomes the perceived deficiencies in the prior art. For example, the present invention discloses an improved cover device for an optical instrument, more specifically binoculars, that is less complicated, easier to use and generally more desirable and versatile than prior art constructions.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall there between.

What is claimed is:

1. A combination carrying case and optical device having a "look into" end and a "see out of" end, wherein the carrying case of the combination comprises:

a front panel having an inner side surface to which the optical device is coupleable and oriented such that the front panel has a "look into" end and a "see out of" end and also having at least a first edge, a back panel, having at least a first edge, and coupled to the front panel, such that the back panel is (i) rotatable about the "see out of" end of the front panel in a direction away from the front panel to an open position and (ii) dimensioned to be rotated in a first direction to cover the "see out of" end and further rotated in a direction that is the same as the first direction so as to wrap around and cover the "look into" end of the optical device to a closed position;

at least one side panel having at least a first edge alignable with the at least first edge of the front panel, and at least a second edge alignable with the at least first edge of the back panel, wherein at least one pair of alignable edges are releasably secured such that the edges are connected in the closed position and disconnected in the open position, and wherein in the open position a line of sight is created between an object, the "see out of" end of the device and the "look into" end of the device.

2. The combination carrying case and optical device as claimed in claim 1, comprising means aligned on (i) at least part of the first edge of the at least one side panel and (ii) at least part of the at least first edge of the main panel, wherein the means provides a releasable connection between the at least one side panel and the main panel.

3. The combination carrying case and optical device as claimed in claim 2, wherein the means comprises magnets.

4. The combination carrying case and optical device as claimed in claim 1, wherein the main panel has at least a second edge and the back panel has at least a second edge, comprising at least a second side panel having:

at least a first edge alignable with the at least second edge of the main panel, and at least a second edge alignable with the at least second edge of the back panel wherein at least one pair of alignable edges are releasably secured such that the edges are connected in the closed position and disconnected in the open position, the at least second side panel being positioned opposite the first side panel.

5. The combination carrying case and optical device as claimed in claim 1, comprising an extension of the back panel as a cover flap, one end of which is integrally formed with the back panel and the other end of which is releasably secured to the main panel.

6. The combination carrying case and optical device as claimed in claim 5, wherein the releasable securing of said cover flap is accomplished using magnets.

7. The combination carrying case and optical device as claimed in claim 5, comprising a grippable tab extending past the edge of the cover flap.

8. The combination carrying case and optical device as claimed in claim 1, wherein the main panel is jointed or flexible such that one segment of the main panel may rotate with respect to another.

9. The combination carrying case and optical device as claimed in claim 1, wherein the back panel is jointed or flexible such that one segment of the back panel may rotate with respect to another.

10. The combination carrying case and optical device as claimed in claim 1, wherein at least two panels are formed out of a contiguous piece of material.

11. The combination carrying case and optical device as claimed in claim 1, wherein the main panel is made of flexible material and can conform to the shape of the device.

12. The combination carrying case and optical device as claimed in claim 1, comprising an intermediate member attached to both the main panel and the device to secure the device to the main panel.

13. The combination carrying case and optical device as claimed in claim 1, wherein the device is secured to the main panel through the use of an elastic band.

14. The combination carrying case and optical device as claimed in claim 1, wherein the coupleable device is secured to the main panel through the use of hook and pile (Velcro).

15. The combination carrying case and optical device as claimed in claim 1, wherein at least one aperture exists in the closed position such that a neck cord, belt clip, or other carrying means may be connected directly to the device, through the at least one aperture.

16. The combination carrying case and optical device as claimed in claim 1, comprising a carrying means directly attached to the main panel.

* * * * *